US006659067B1

(12) United States Patent
Al-Hawaj

(10) Patent No.: US 6,659,067 B1
(45) Date of Patent: Dec. 9, 2003

(54) RADIAL VANE ROTARY DEVICE AND METHOD OF VANE ACTUATION

(76) Inventor: Osamah Mohammed Al-Hawaj, P.O. Box 15462, Daiyah (KW)

( * ) Notice: Subject to any disclaimer, the term of this patent is extended or adjusted under 35 U.S.C. 154(b) by 0 days.

(21) Appl. No.: 10/246,973

(22) Filed: Sep. 19, 2002

Related U.S. Application Data

(63) Continuation-in-part of application No. 10/192,176, filed on Jul. 10, 2002.

(51) Int. Cl.[7] ..... F02B 53/00
(52) U.S. Cl. ..... 123/243; 418/265; 418/260
(58) Field of Search ..... 123/243, 245; 418/268, 267, 219, 46, 260, 265

(56) References Cited

U.S. PATENT DOCUMENTS

| | | | | | |
|---|---|---|---|---|---|
| 3,568,645 | A | * | 3/1971 | Grimm | 418/264 |
| 3,812,828 | A | * | 5/1974 | Griffiths | 418/61.1 |
| 3,929,105 | A | * | 12/1975 | Chisholm | 123/205 |
| 4,018,191 | A | | 4/1977 | Lloyd | 123/243 |
| 4,353,337 | A | | 10/1982 | Rosaen | 123/243 |
| 4,355,965 | A | | 10/1982 | Lowther | 418/111 |
| 5,415,141 | A | | 5/1995 | McCann | 123/243 |
| 5,727,517 | A | * | 3/1998 | Mallen | 123/217 |
| 6,030,195 | A | | 2/2000 | Pingston | 418/82 |

* cited by examiner

*Primary Examiner*—Hoang Nguyen
(74) *Attorney, Agent, or Firm*—David Kiewit

(57) ABSTRACT

A family of sliding vane rotary power devices provides an internal combustion engine, a pump, a compressor, a fluid-driven motor, an expander device, a fluid-driven pump, and a compressor or a throttling device. All of these devices have an improved method of vane actuation comprising a freely sliding element partially enclosed by a medially extended outer vane portion and partly enclosed at its ends by a mirror-image encircling cam groove formed in a circumferentially-split external housing. As the rotor turns, the sliding elements engage the encircling extended vane portion and the mirror-image cam grooves cause the vanes to reciprocate radially in respective rotor slots while the outer vane tips follow the wall contour of the rotor with a minimal clearance so that the cavities rotate with the rotor and expand and contract as the rotor turns. Various devices in the family of devices differ both in the configuration of an internal stator member about which the rotor assembly turns and in the disposition of ports.

19 Claims, 14 Drawing Sheets

43
32b
48
49
32a
37
28
4

60
24
62
47
62
4
56

RADIAL VANE ROTARY DEVICE AND METHOD OF VANE ACTUATION

CROSS REFERENCE TO RELATED APPLICATIONS

This application is a continuation-in-part of the inventor's U.S. patent application having Ser. No. 10/192,176, which was filed on Jul. 10, 2002. The disclosure of application Ser. No. 10/192,176 is herein incorporated by reference.

FIELD OF THE INVENTION

The invention relates to sliding vane rotary power devices, and more particularly to internal combustion engines, pumps, compressors, fluid-driven motors, expander devices, fluid-driven pumps and compressors, where various ones of those devices differ from others by a simple modification of a central stator member.

BACKGROUND OF THE INVENTION

This invention relates to a rotary power device of the radial sliding vane type. These types of devices are characterized in having a rotor assembly comprising a number of vanes equally spaced about the rotor so as to divide the rotor chamber into discrete cavities. As the rotor turns, the vanes follow the wall contour of the rotor chamber and thereby provide cavities that rotate with the rotor. The rotor chamber has an axis that can be concentric or eccentric with respect to the axis of the rotating member. This invention belongs to the former type in which the axis of the substantially oval-shaped chamber coincides with the axis of rotation and the chamber comprises two diametrically opposed quadrants of expanding cavities that are alternated by another two quadrants of contracting cavities. In a typical four-cycle engine the processes of intake, compression, power and exhaust are distributed equally among the four quadrants. Additionally, the sliding vane device of the present invention can be configured to operate as a double-action pump or compressor, an expander device, a fluid-driven pump or compressor and a two-cycle internal combustion primarily through the replacement of a central stationary member and a rearrangement of exhaust ports.

Sliding vane rotary devices generally comprise straight vanes slidably received within respective slots radially formed in a rotor. As the rotor spins, vanes are driven outward by centrifugal forces to an extent constrained by the wall contour, and execute radially reciprocating motion as the rotor spins. In an effort to reduce vane tip loading and increase outward radial movement response, a variety of vane actuation methods have been developed. One class of devices employs a biasing spring disposed at the base of the vane. Another class uses a pair of controlling sidewall cam grooves engaged by sub-shafts fixed to lower side portions of a vane. Still another class uses a transfer passage connecting a pressurized fluid to the base of the vanes. Although the functionality of such means of vane actuation have been proven, they are characterized in some respects with excessive friction, fluid slip, leakage, and complexity. Examples of rotary devices of the above type can be found in various United States patents such as U.S. Pat. No. 6,030,195 to Pingston; U.S. Pat. No. 4,355,965 to Lowther; U.S. Pat. No. 5,415,141 to McCann; U.S. Pat. No. 4,353,337 to Rosaen; and U.S. Pat. No. 4,018,191 to Lloyd.

SUMMARY OF THE INVENTION

The present invention provides a rotary power device that can be configured, among other things, to serve as a two or a four cycle internal combustion engine, a motor-driven pump or compressor, a fluid driven pump or a compressor by replacing a stationary central member. Preferred embodiments of the invention comprise a toroidal block rotor assembly having a centrally bored portion. This rotor assembly may be fixedly secured to an end shaft and rotatably carried at one end of an external stator housing. The central bored portion of the rotor communicates with a plurality of radially disposed open-ended compartments. The radial compartments are disposed alternatively along the circumference of the rotor so as to provide an equal number of radial slots. An external stator portion of the device preferably comprises a partially toroidal chamber having an axis coincident with the rotational axis of the device. In a preferred embodiment of the external stator, the toroidal chamber is split along a plane perpendicular to the axis at a point corresponding to the center of the rotor, thus forming two mating halves. Each half comprises a cam groove along an edge of the respective mating face. When the external stator is assembled, the two grooves mate together to form a single cam track having a contour similar in shape to the inner peripheral toroidal wall contour. Moreover, as is shown in FIGS. 4 and 5, the preferred cam track has a re-entrant, or undercut, shape when viewed in a radial section perpendicular to the track so that the track can capture a cam follower. Sliding and rolling cam follower elements, such as ball elements, can engage this track and be captured therein. Each preferred vane comprises an outer tip ring portion for enclosing a respective ball element that is entrapped within the cam track so as to serve as a cam follower. The tip ring portion is fixedly connected to the main body of the preferred vane by an elongated portion having a diameter selected to fit through a narrow neck portion of the reentrant cam track. Because the preferred cam follower and track arrangement provides for capturing the follower within the track, this arrangement allows each associated vane to be both pulled away from the axis of rotation and pushed towards the axis of rotation, thus causing reciprocating sliding movement of the vanes in their respective slots as the rotor rotates.

Furthermore, preferred devices comprise an internal stator fixedly secured to the external stator and rotatably enclosed, with clearance, within the central bored portion of the rotor. The internal stator comprises channels connected to ports communicating with inner opening of the rotor compartments. As the rotor spins, a cavity formed between two adjacent vanes defining a radial compartment intermittently communicates with the ports in the internal stator so as to perform intake, compression, power and exhaust functions. Other embodiments may comprise ports and passages in both the internal and the external stator portions. In addition to embodiments serving as two-cycle or four-cycle internal combustion engines, the rotary device of the invention can function as motor-driven or fluid-driven pump or compressor by replacing the internal stator with one having an appropriate port and channel configuration.

One object of some embodiments of the invention is to provide a radial sliding vane power device having a simple, efficient and less costly means of vane actuation.

A further object of some embodiments of the invention is to provide an improved radial vane rotary power device that is light in weight, small in size and that has the minimum number of parts.

Another object of some embodiments of the invention is to provide a rotary power device that can be easily converted to other type of rotary power device such as four-cycle or two-cycle internal combustion engine, pump, compressor, expander, fluid-driven motor and fluid-driven pump devices by a simple modification or replacement of a central stationary member.

Another object of some embodiments of the invention is to provide a rotary power device that closely approximates continuous intake, compression, combustion and discharge processes.

Yet another object of some embodiments of the invention is to provide a dynamically balanced radial vane rotary power device characterized by reduced noise and vibration.

An additional object of some embodiments of the invention is to provide a rotary power device with reduced friction, fluid slip and leakage.

These and other objects and advantages of the present invention will be apparent from the following detailed description and the appended claims.

Although it is believed that the foregoing recital of features and advantages may be of use to one who is skilled in the art and wishes to learn how to practice the invention, it will be recognized that the foregoing is not intended to list all of the features and advantages. Moreover, it may be noted that various embodiments of the invention may provide various combinations of the hereinbefore cited features and advantages of the invention, and that less than all of the recited features and advantages of the invention may be provided by some embodiments.

DETAILED DESCRIPTION OF THE INVENTION

Figure 1:
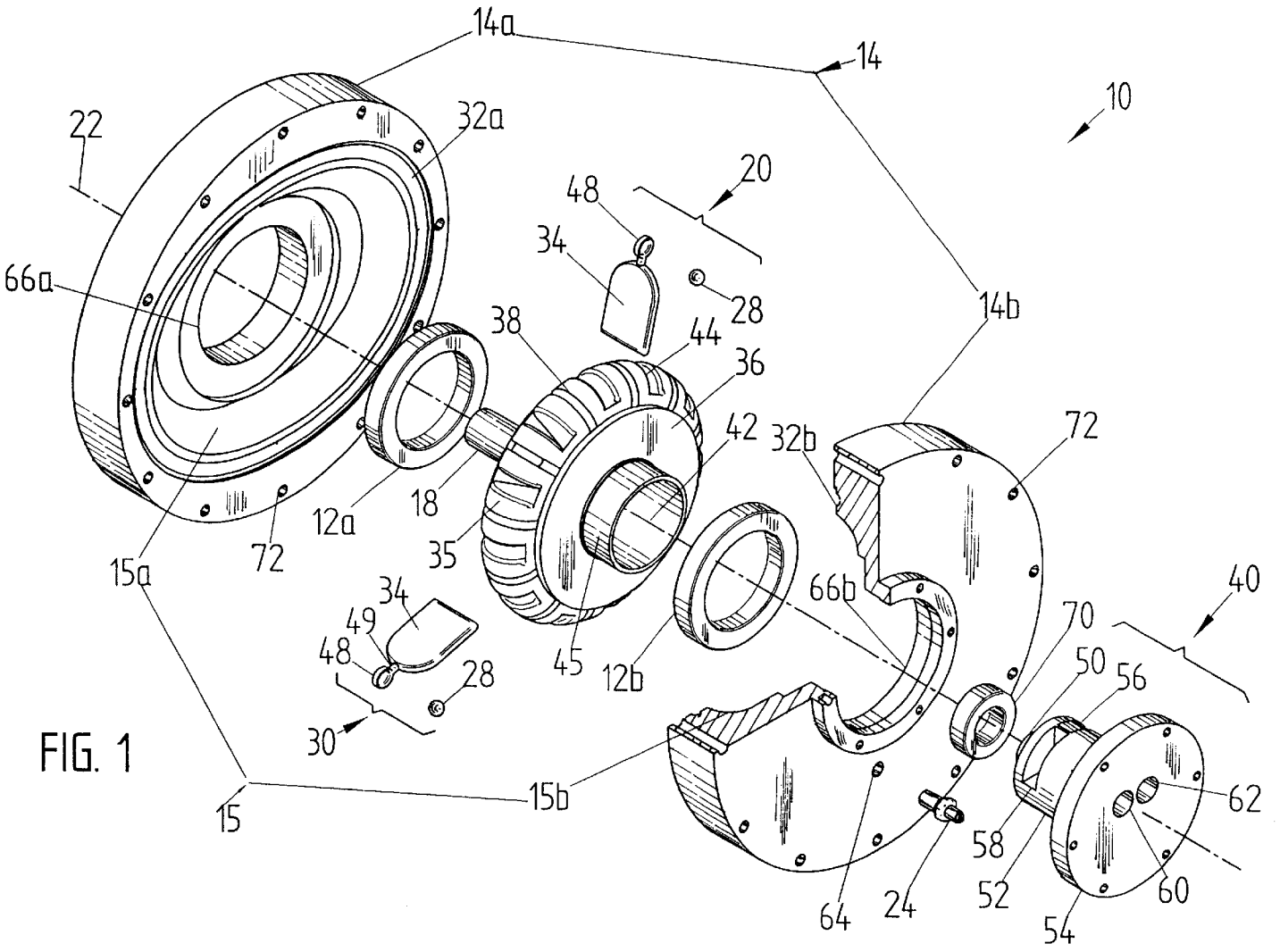
FIG. 1 is an exploded isometric view of a rotary power device of the invention with a portion of a housing cut away for purposes of illustration.

Referring initially to FIG. 1, one finds a rotary power device 10 operable as a four-cycle internal combustion engine. This device comprises an external stator portion 14 comprising an elliptical chamber having a peripheral wall 15 that, when viewed in a plane including the axis of rotation 22, has a semi-circular shape. The peripheral wall comprises a medially surrounding cam track 32. The preferred chamber is depicted split along a medial transverse plane perpendicular to the axis of the device, thereby forming two mating stator portions: a front stator portion 14*a* and a back stator portion 14*b*. Each stator portion 14*a*, 14*b* comprises a respective peripheral wall portion 15*a* and 15*b*. The two stator portions preferably comprise respective mirror-image cam groove portions 32*a*, 32*b* open to the medial transverse plane and proximal to the outer peripheral surface of the chamber so as to provide a preferred reentrant cam track 32 when the two portions 14*a*, 14*b* of the stator are clamped together. Thus, the preferred cam track 32 has mirror symmetry about the medial transverse plane, which is perpendicular to the axis of rotation. This cam track comprises a relatively narrow neck-like passageway extending from the rotor chamber to an enlarged region in which a cam follower may be captured.

The front external stator portion 14*a* comprises a central opening 66*a* for rotatably carrying the protruding rotor shaft 18, and the back external stator portion 14*b* comprises another central opening 66*b* for fixedly mounting a centrally protruding internal stator portion 40. The two mating external stator portions are fixed together by fixture means such as tie rods (not shown) extending through a set of aligned holes 72. The back external portion may comprise a side ignition port 64 for mounting an ignition means 24 such as a spark or glow plug.

The internal stator portion 40 may be fixedly attached to the back external stator portion through a flange portion 54 by fixture means (not shown). This internal stator portion preferably comprises a cylindrical inwardly projecting portion 52 which comprises a pair of peripheral ports comprising an intake port 56 and exhaust port 58. These ports may be formed as respective cutouts on the peripheral wall of the stator, where each port may be defined within an approximate 90-degree angular extension. Each of the ports 56, 58 is preferably connected to a respective intake 62 or exhaust 60 channel.

Figure 2:
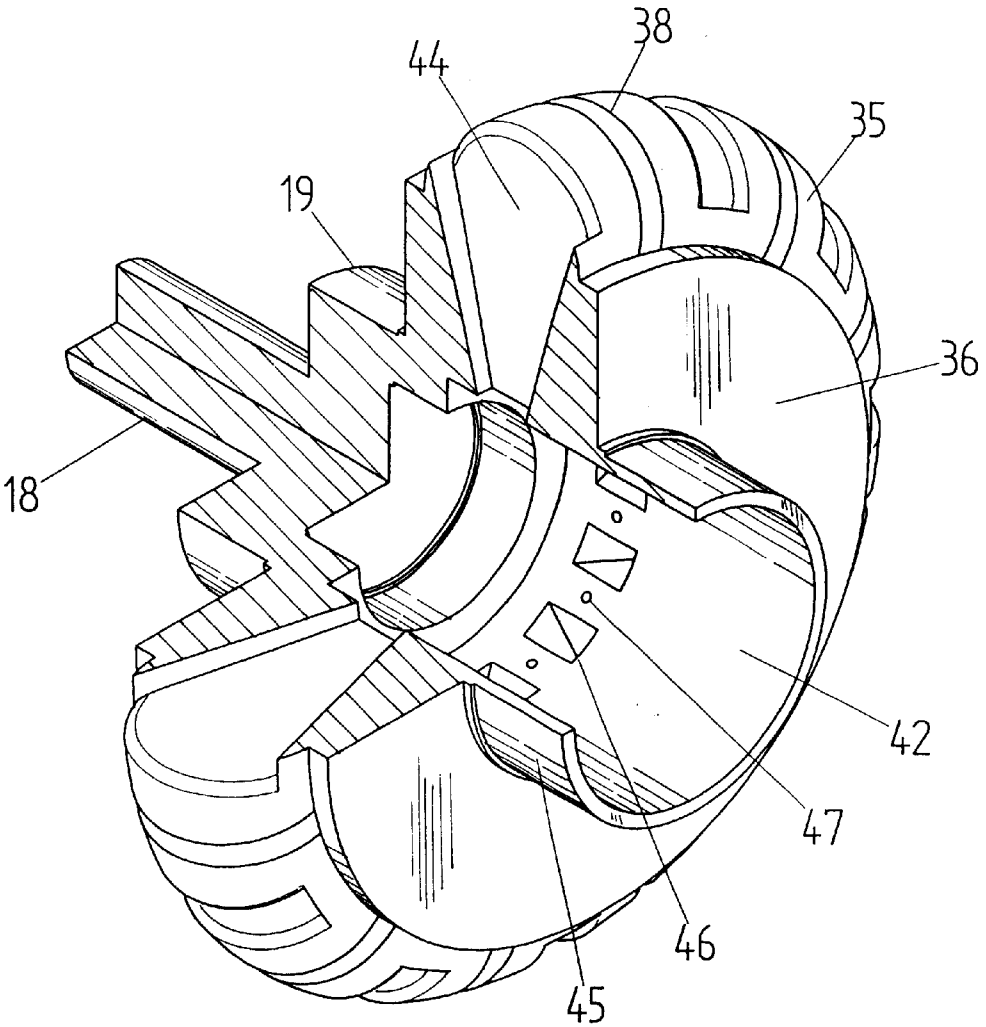
FIG. 2 is an isometric view of a rotor having a portion cut away for purposes of illustration.
Figures 3, 4, 5:
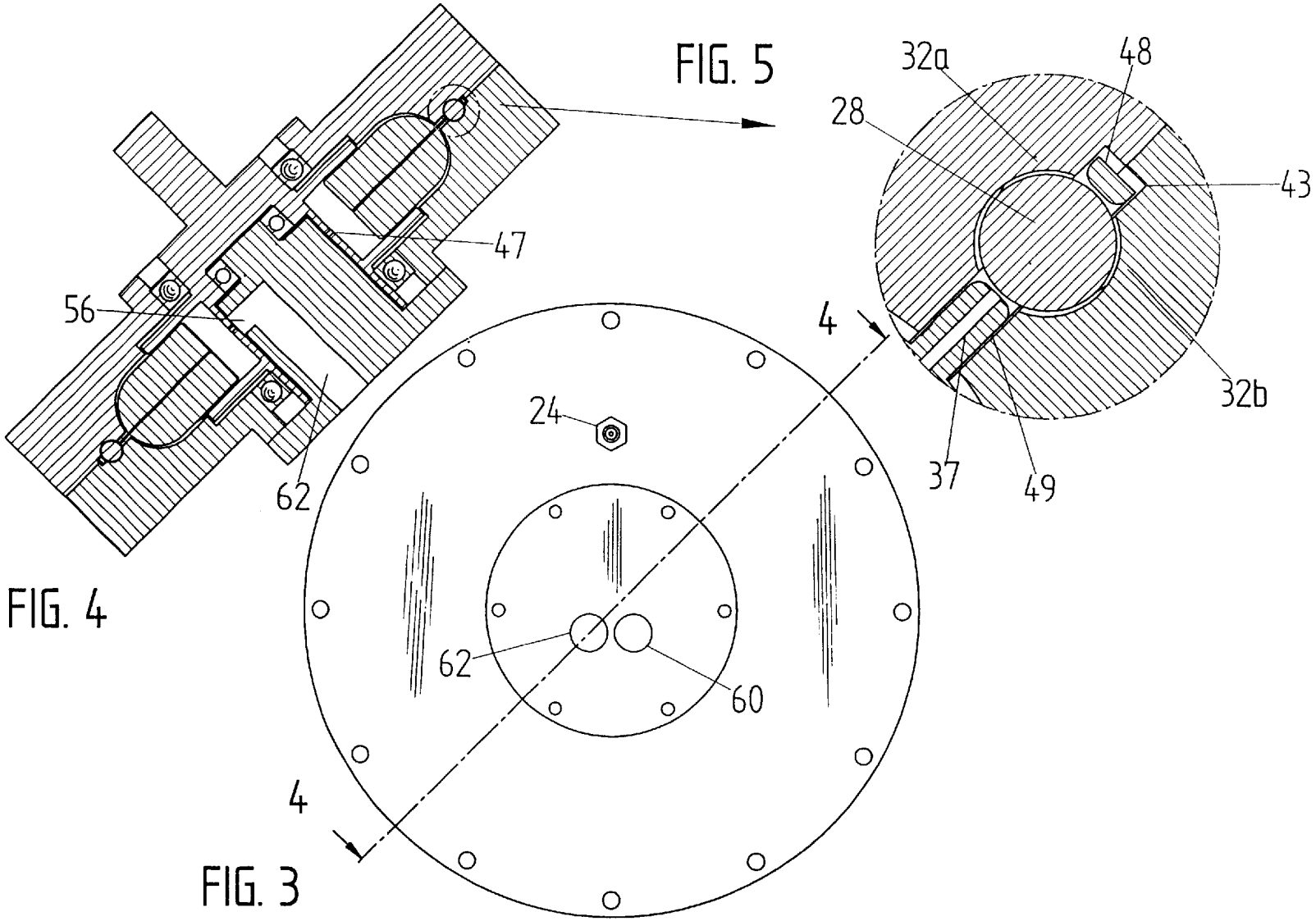
FIG. 3 is an end view of the rotary power device of FIG. 1.
FIG. 4 is a cross-sectional view taken along 4—4 of FIG. 3.
FIG. 5 is a detailed cross-sectional view of a portion of the apparatus that is encircled in FIG. 4.

A preferred rotor assembly 20 is concentrically mounted within the substantially annular chamber defined by the inner walls of the external stator portions and a peripheral wall of the internal stator portion. A preferred rotor assembly comprises, as depicted in FIG. 2, a cylindrical block 36 comprising a front hub portion 19, a back hub portion 45 and a central end shaft 18. The cylindrical block may comprise a peripheral wall portion 35 having a semi-circular cross-section. The cylindrical block may further comprise a multiplicity of open-ended radial compartments 44 communicating with a central bore portion 42 by means of respective inner opening 46. There is also an equal multiplicity of radial slots 38 disposed in alternating relationship with the radial compartments, so that each radial slot is closed at the sides and communicates with the central bore by means of openings 47. The rotor assembly is preferably rotatably mounted within the external stator by means of a front ball bearing 12*a* and a back ball bearing 12*b*. A floating internal bearing 70 may be mounted between a stepped portion of the central bore and a recessed end portion 50 of the central internal stator, as shown in FIG. 4. The advantage of using an internal bearing 70 is to maintain a close-tolerance fixed clearance between the peripheral wall of the internal stator and the inner wall of the central bore under varying load conditions.

A multiplicity of vane assemblies 30 is preferably disposed in the rotor chamber, and arranged so that each vane assembly comprises a vane plate portion 34 having three straight sides and one outer semi-circular side, a ring portion 48 fixed to the outer middle tip of the semi-circular vane portion by means of an extended stub portion 49 that extends radially outward from the vane plate portion, and a ball cam follower element 28 freely enclosed by the ring portion 48. During assembly, vane elements with respective ball elements are momentarily disposed in one cam groove portion, such as the front cam portion 32*a* of the front external stator portion 14*a*, and then closed in by mating the second external stator portion 14*b* with its respective cam groove portion 32*b*. As the rotor spins, the vanes reciprocate outwardly and inwardly along respective radii, where the motion of the vanes is controlled and guided by the annular cam 32 engaging the ball elements 28 entrapped within the vane ring portions 48. As the rotor spins, the ball elements 28, as shown in FIG. 5, may make contact with the outer circular wall portions or the inner circular wall portions of the cam track while the semi-circular vane tip forms a small clearance with the inner semi-circular peripheral wall, thereby reducing vane tip loading. The ball elements may be made from a self-lubricating material to eliminate the need for oil lubrication. Alternatively, oil lubrication may be provided by injecting oil mixed with an intake charge or by direct injection of oil into the cam groove through an external channel (not shown). The vane may comprise a channel 37, as shown in FIG. 4 and FIG. 5, connecting the base of the vane to an inner wall portion of the ring 48 as a means of enhancing ball-fluid lubrication. Furthermore, the exemplar engine may be cooled by provision of water jacket cooling passages within the external stator (not shown).

Figure 6:
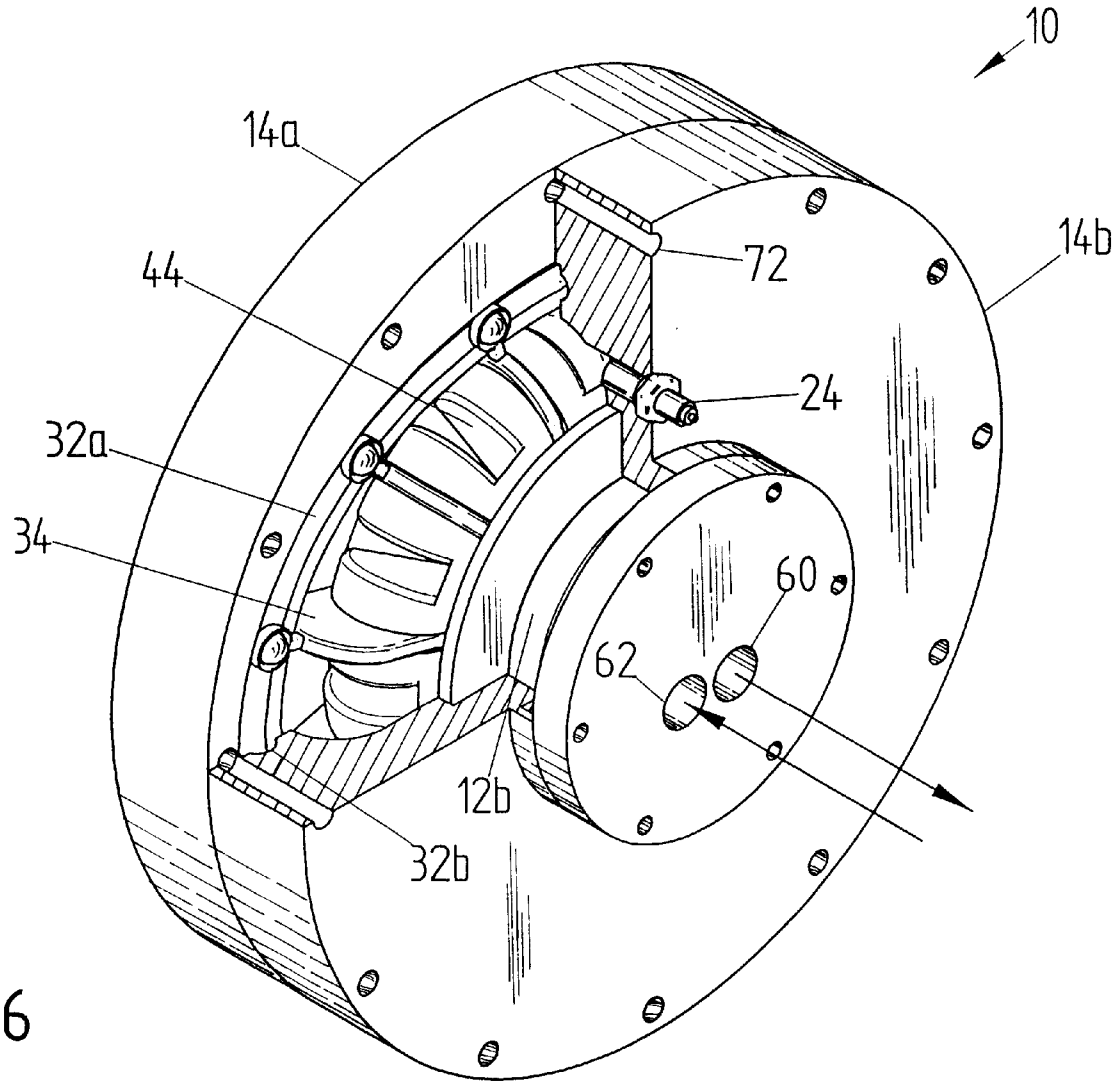
FIG. 6 is an isometric view of a rotary power device of FIG. 1 configured for operation as four-cycle internal combustion engine. A portion of the external stator has been cut away for purposes of illustration.

An embodiment of the rotary power device 10 functioning as a four-cycle internal combustion engine, as shown in FIG. 6, comprises respective intake and exhaust passageways 60, 62 provided in the central internal stator and connected to respective peripheral intake 56, and exhaust 58 ports, where the ports may be axially aligned with inner openings 46 of the rotor radial compartments 44. In addition, an ignition means 24 may be provided through an ignition port 64 in the side wall of the external stator portion so that the ignition means can communicate sequentially with each of the chambers as the rotor assembly rotates.

Figure 6A:
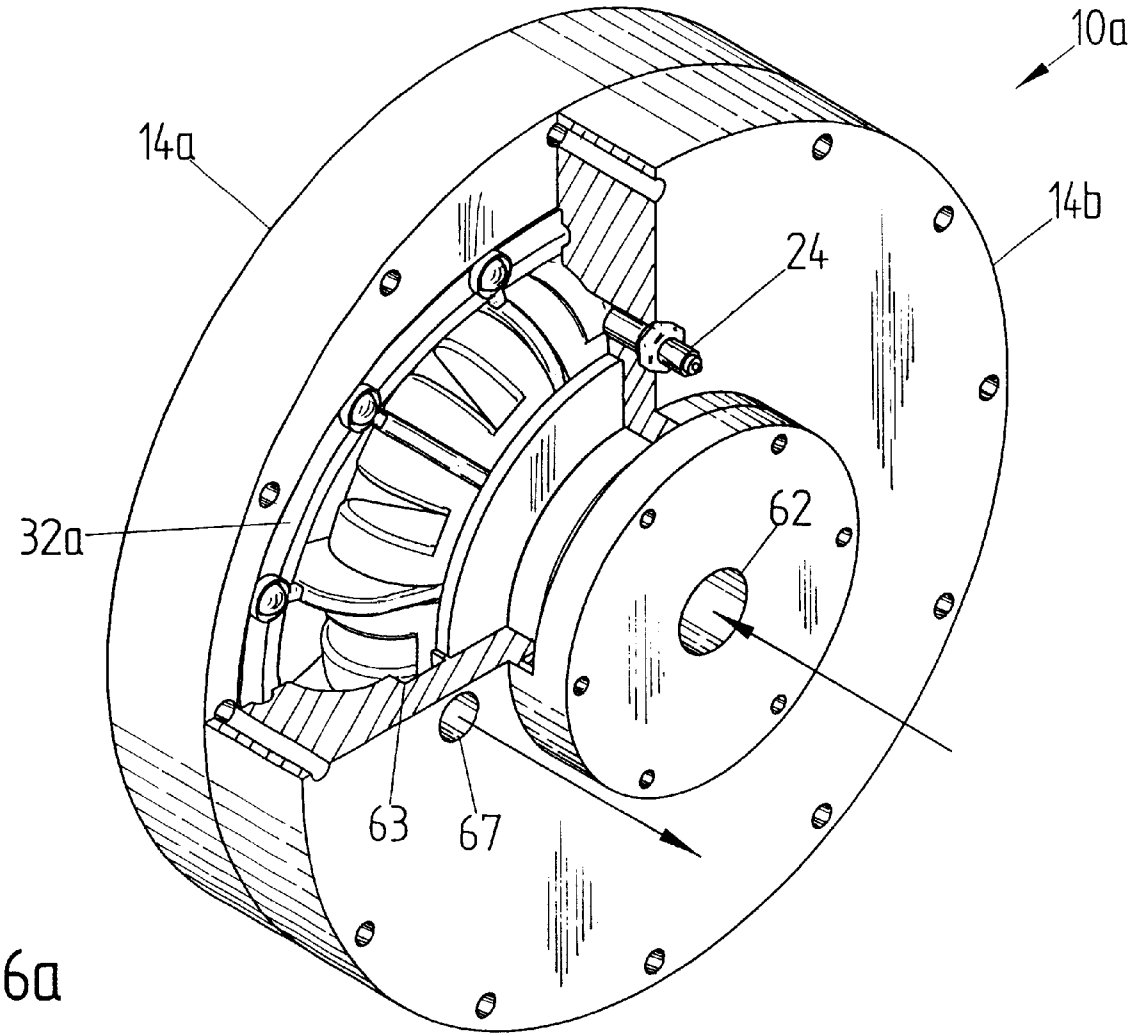
FIG. 6*a* is an isometric view of another rotary power device of the invention arranged to operate as four-cycle internal combustion engine. A portion of the external stator is cut away for purposes of illustration.

An alternative embodiment of a four-cycle rotary power device if the invention 10*a* is shown in FIG. 6*a*. In this embodiment the internal stator portion comprises an intake passageway 62 leading to a peripheral intake port 56 axially aligned with inner openings 46 of the rotor radial compartments 44; and the external stator portion comprises the exhaust passageway 63 and the ignition means 24. Here, the exhaust passageway 63 comprises a recessed wall portion in the inner wall of the external stator that is defined over a ninety degree angular displacement and is connected to an exhaust port 67.

Figure 6B:
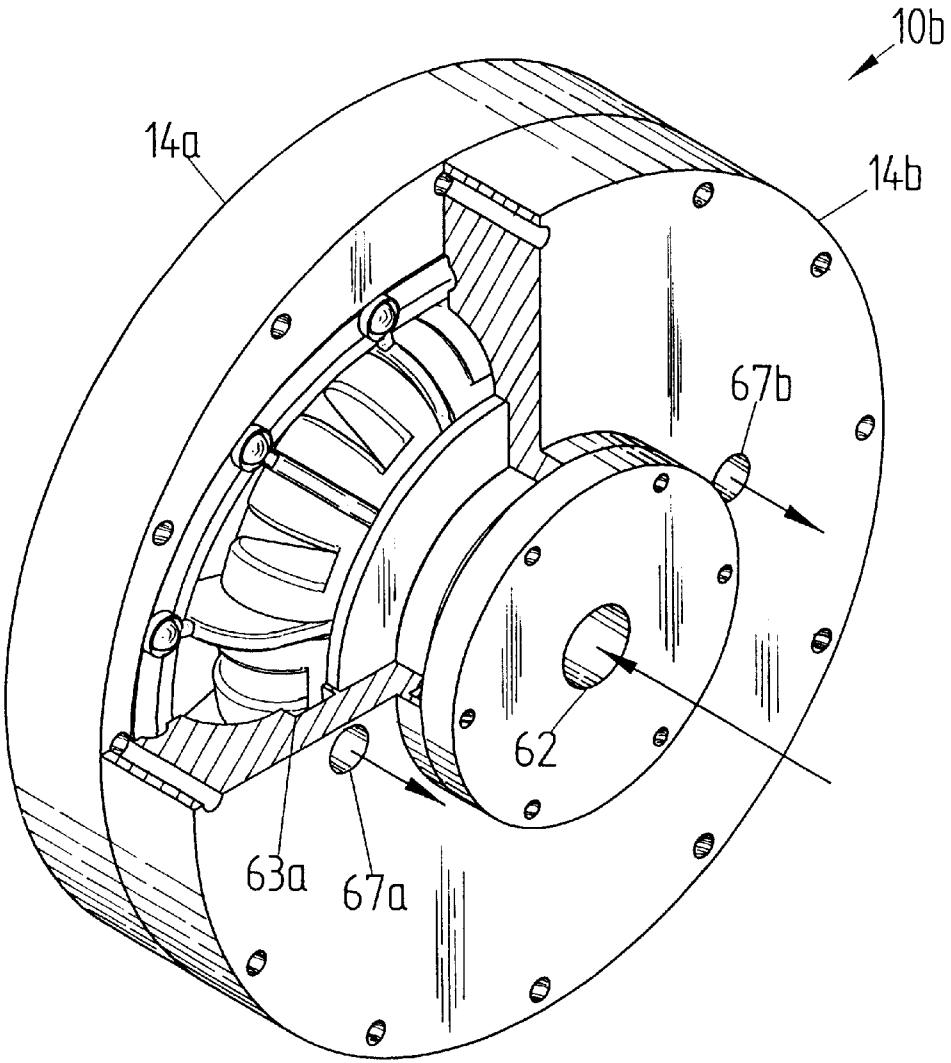
FIG. 6*b* is an isometric view of yet another rotary power device of the invention arranged to operate as a motor-driven pump or compressor. A portion of the external stator in this figure is cut away for purposes of illustration.

Another embodiment 10*b* is operable as one of a motor-driven pump/compressor device or a fluid-driven motor, as shown in FIG. 6*b*. Here, the internal stator portion comprises an intake passageway 62 leading to diametrically opposed intake ports 56*a* and 56*b*; and the external stator portion comprises a pair of diametrically opposed exhaust passageways 63*a*, 63*b* formed within the internal wall of the external chamber and connected to respective discharge ports 67*a*, 67*b*.

Figure 6C:
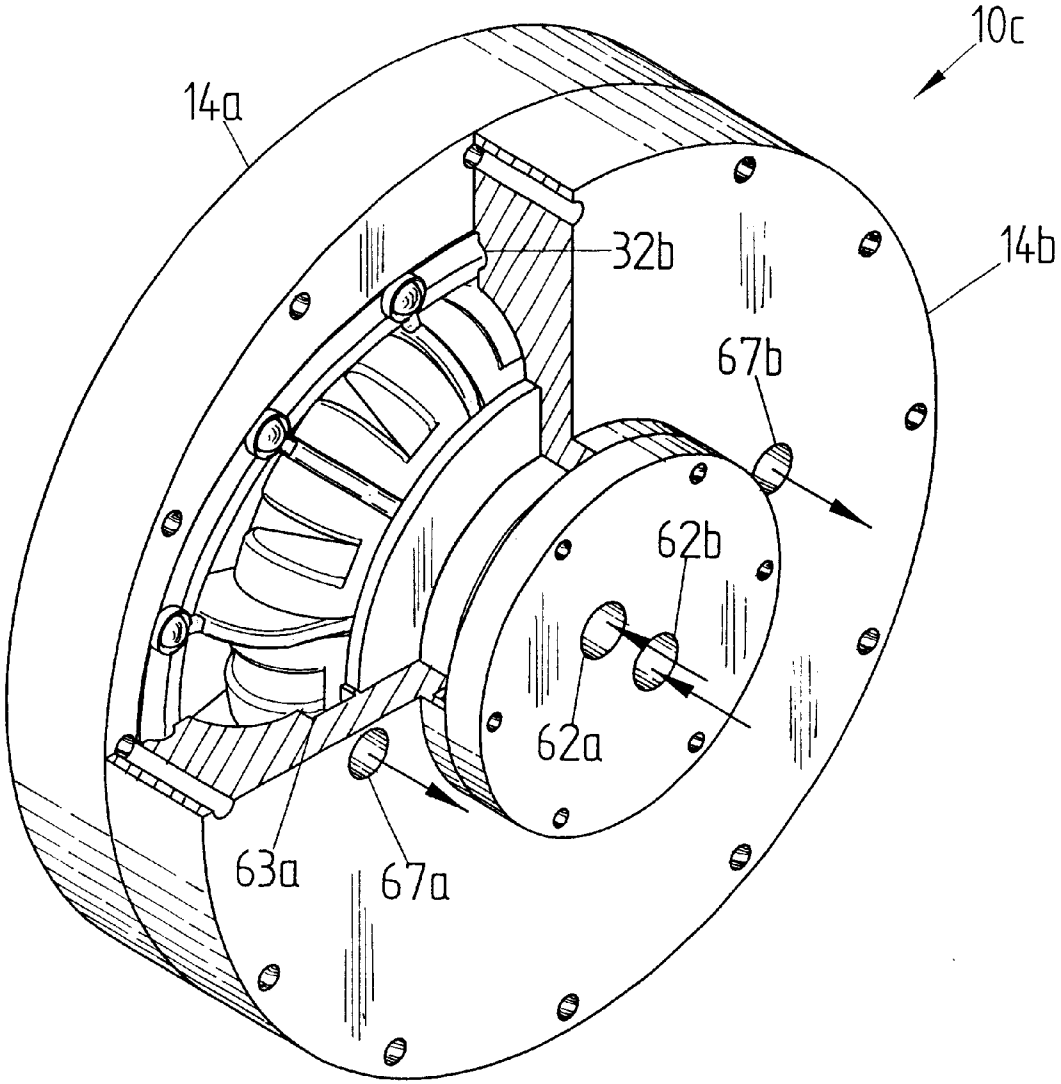
FIG. 6*c* is an isometric view of still another rotary power device of the invention arranged to operate as a fluid-driven pump or compressor. A portion of the external stator in this figure has been cut away for purposes of illustration.

Yet another embodiment 10*c* is operable as one of a fluid-driven pump/ compressor device, as shown in FIG. 6*c*. In this embodiment the internal stator portion comprises two separate intake passageways 62*a*, 62*b* leading to respective diametrically opposed intake ports 56*a*, 56*b*. Each of these passageways is in communication with a differently pressurized fluid source. The external stator portion comprises a pair of diametrically opposed exhaust passageways 63*a*, 63*b* formed as recessed wall portion within the internal wall of the chamber and connected to respective discharge ports 67*a*, 67*b* respectively associated with the two fluids.

Figure 6D:
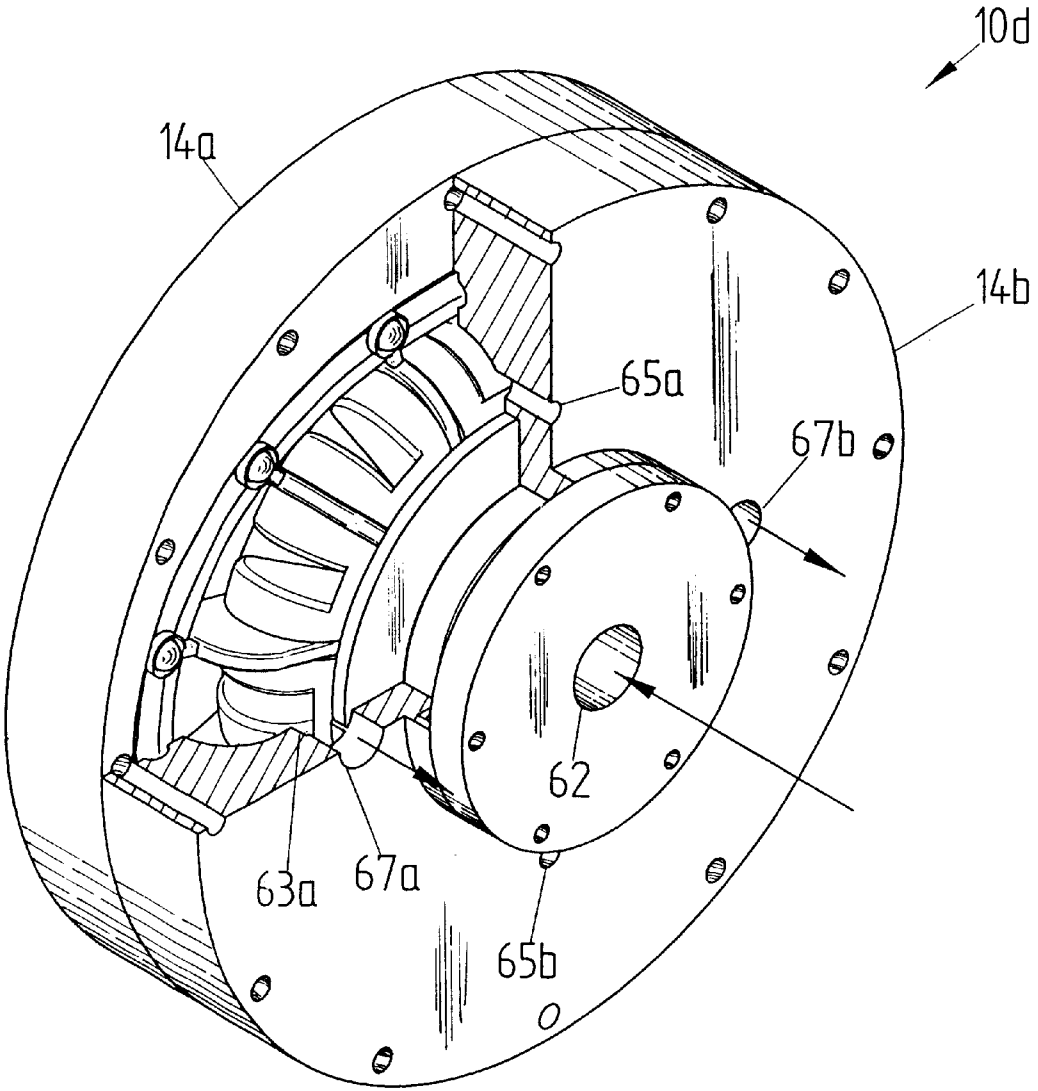
FIG. 6*d* is an isometric view of a yet another rotary power device of the invention that is arranged to operate as a two-cycle internal combustion engine. A portion of the external stator is cut away in this figure for purposes of illustration.

An embodiment 10*d* operable as a two-cycle internal combustion engine is shown in FIG. 6*d*. Here, the internal stator portion comprises an intake passageway 62 leading to diametrically opposed intake ports; and the external stator portion comprises a pair of diametrically opposed exhaust passageways 63*a*, 63*b* formed as recessed wall portions within the internal wall of the external stator and connected to respective discharge ports 67*a*, 67*b*. A pair of diametrically opposed ignition ports 65*a*, 65*b* formed in the side wall of the external stator may be provided to receive respective ignition means, such as a fuel injecting means.

Figure 7:
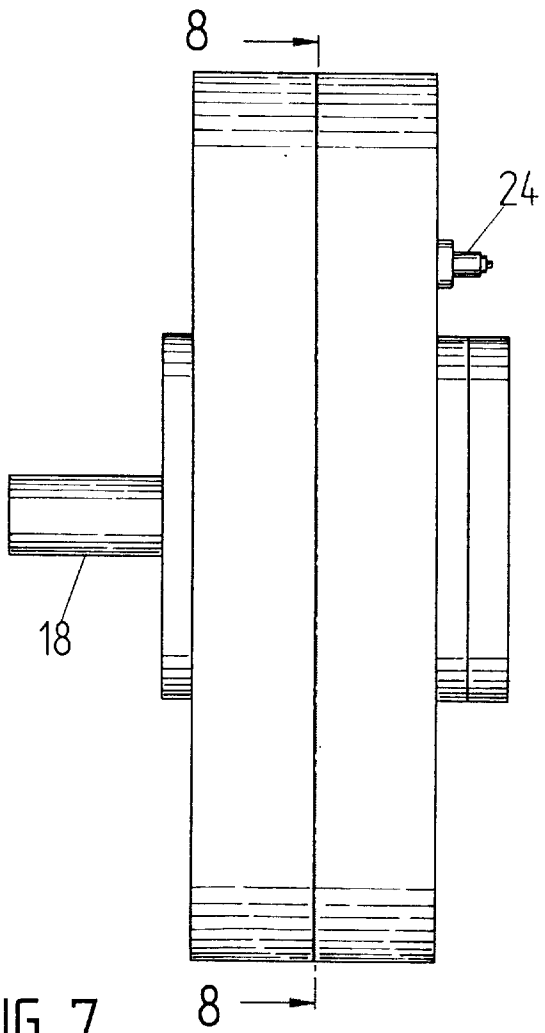
FIG. 7 is a side elevation view of the rotary power device of FIG. 6.
Figure 8:
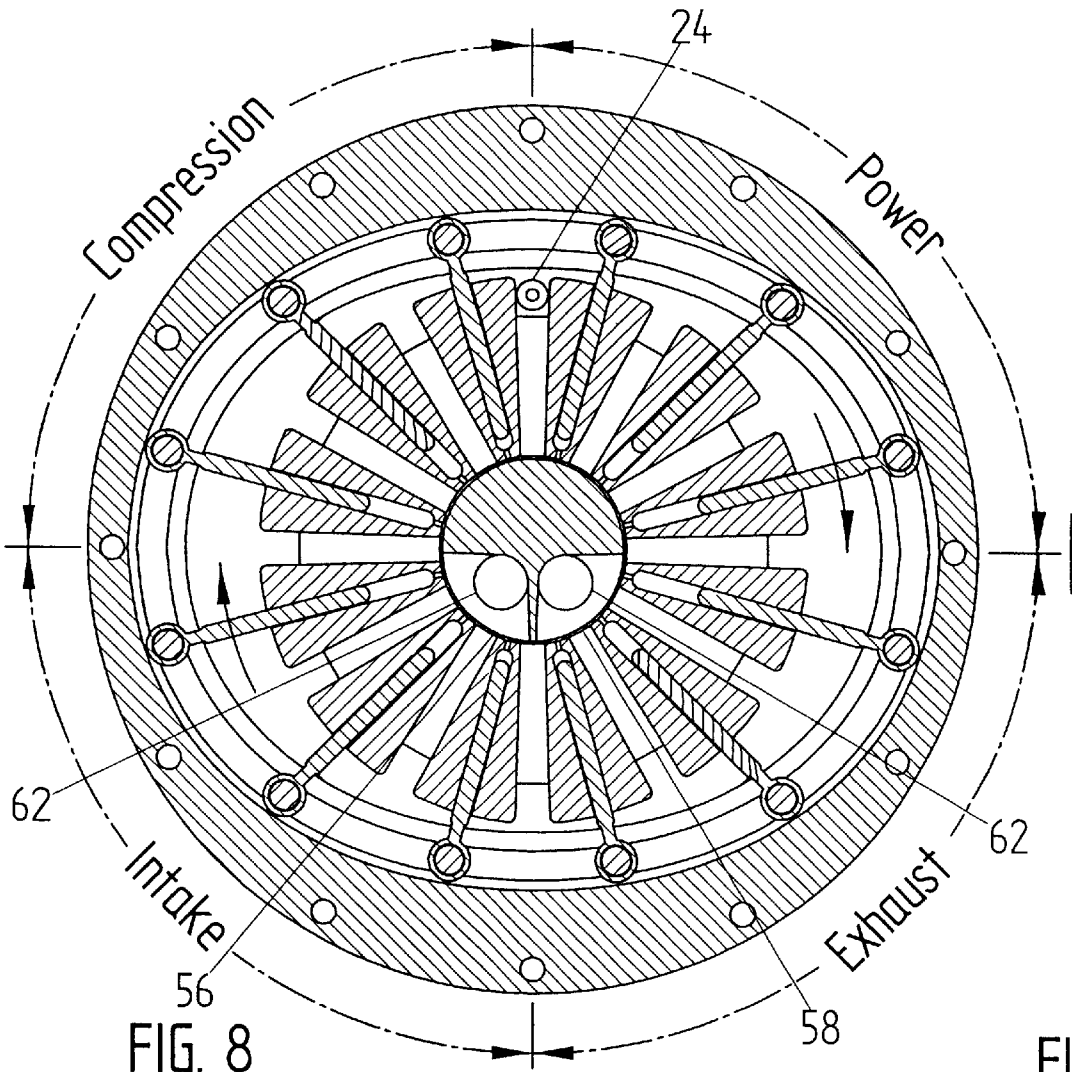
FIG. 8 is a sectional view taken along line 8—8 of FIG. 7.

In operation as a four-cycle internal combustion engine, FIG. 7 and FIG. 8 presents views of the engine corresponding to the embodiment shown in FIG. 1 and FIG. 6. In this embodiment a starter motor (not shown) is connected to the shaft 18 to initiate the rotation of the rotor 20 to start the engine. Each cavity is bounded by two adjacent extended vanes and encloses a radial compartment 44 that moves through four phases comprising intake, compression, power and exhaust phases at the completion of revolution, each phase taking place within a 90° angular displacement of the rotor. Step by step operation of the four phase internal combustion is explained with reference to FIG. 8. For example, consider a clockwise rotation of the rotor and the movement of a cavity bounded by two adjacent vanes starting at the bottom-most position where the cavity volume is minimum, which corresponds to top dead center (TDC) in a conventional reciprocating engine. As the rotor turns, the volume increases gradually and the inlet port 56 in communication with channel 62 of the central internal stator registers with rotor compartment inner openings 46 so as to perform intake of a fuel/air mixture. This phase terminates at the end of a ninety degree angular displacement, at which point the cavity volume attains a maximum value corresponding to the first bottom dead center (BDC) position in a conventional engine. During the second phase, the cavity volume decreases as the inner opening 46 is blocked by the peripheral wall portion of the internal stator, thus compressing the charge. The second phase terminates at a second minimum cavity volume corresponding to the second (TDC) in a conventional engine. During the third phase, the compressed charge is ignited as the cavity registers with the ignition means 24; and subsequently, a power phase is initiated in which the cavity volume increases while the compartment inner openings 46 are blocked again by the cylindrical wall portion 52. The effect of the resultant pressure forces of the expanding gases on the extended vanes provides a larger tangential force on that vane having the larger extended area, which provides the propelling torque causing the rotation of the rotor. The expansion process continues for a ninety degree angular displacement until the cavity volume reaches a second maximum corresponding to the second (BDC) position in a conventional engine. At the beginning of the fourth phase, a brief blowdown of combustion products takes place followed by an exhaust process as the volume decreases while the inner opening 46 registers with the exhaust port 58 in communication with an exhaust channel 60.

Figure 7A:
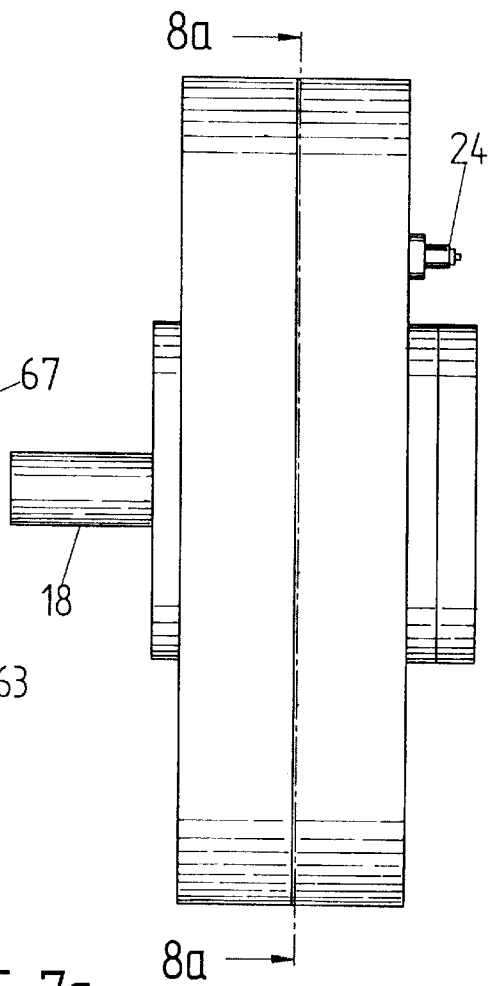
FIG. 7*a* is a side elevation view of the rotary power device of FIG. 6*a*.
Figure 8A:
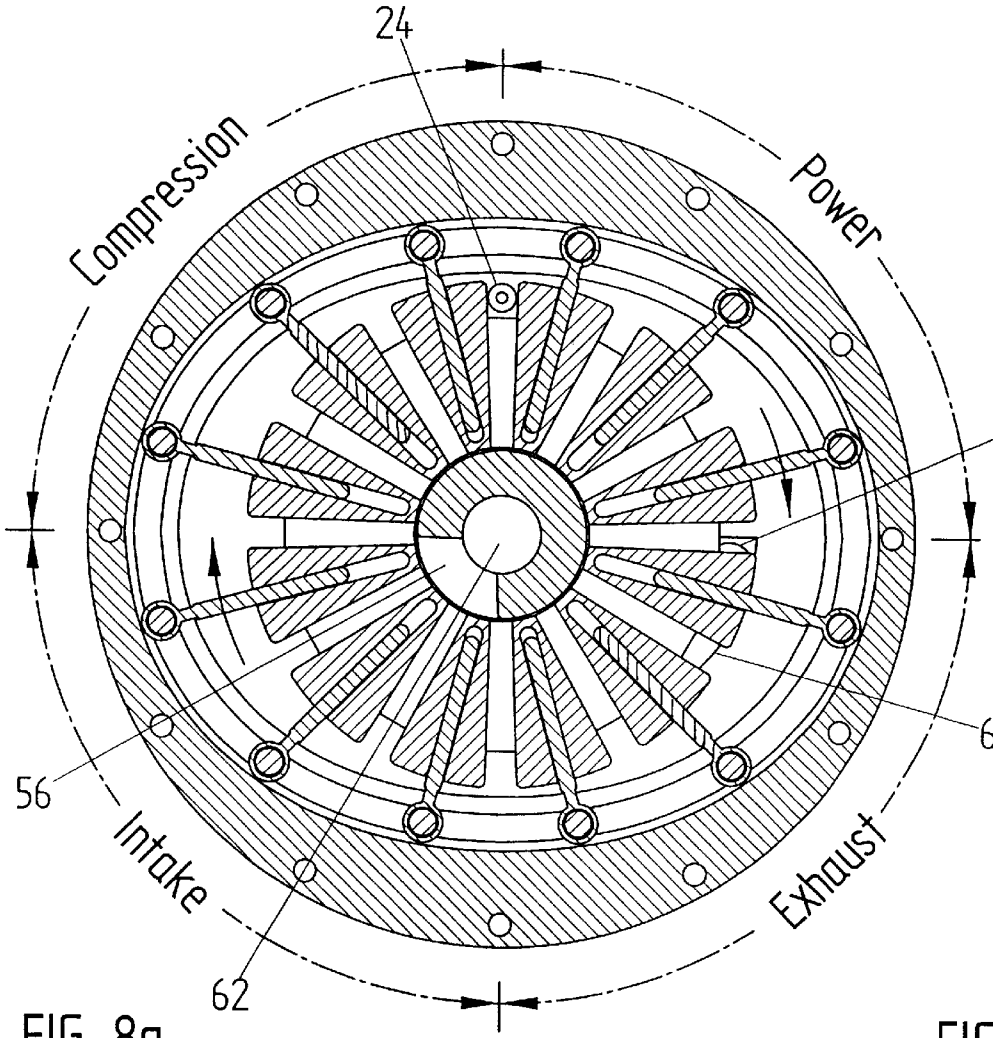
FIG. 8*a* is a sectional view taken along line 8*a*—8*a* of FIG. 7*a*.

An alternative embodiment of a four-cycle internal combustion engine is shown in FIG. 7*a* and FIG. 8*a*, which corresponds to the engine of FIG. 6*a*. The operation of the alternative four-cycle is similar to the original embodiment except for the disposition of the exhaust process. In this embodiment the exhaust process is performed through a passage 63 comprising a recessed wall portion in the inner wall of the external stator in communication with an exhaust port 67. Here, the cavity registers with the exhaust channel 63 while the cavity volume is decreasing, thereby expelling the combustion products through the exhaust passageway 63 connected to the exhaust port 67. One main advantage of this embodiment is to reduce the chance of short-circuiting in which a portion of the combustion products combine with the intake charge.

Figure 7B:
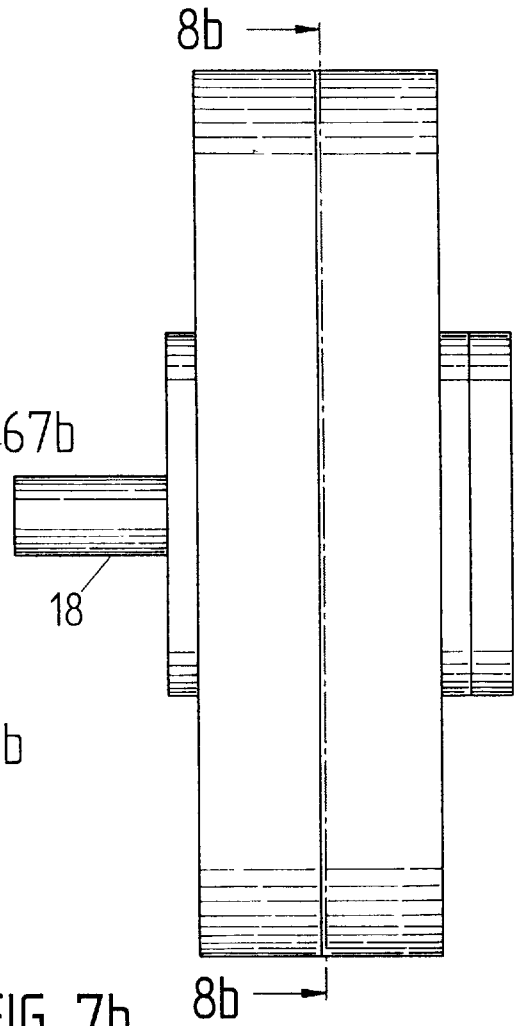
FIG. 7*b* is a side elevation view of the rotary power device of FIG. 6*b*.
Figure 8B:
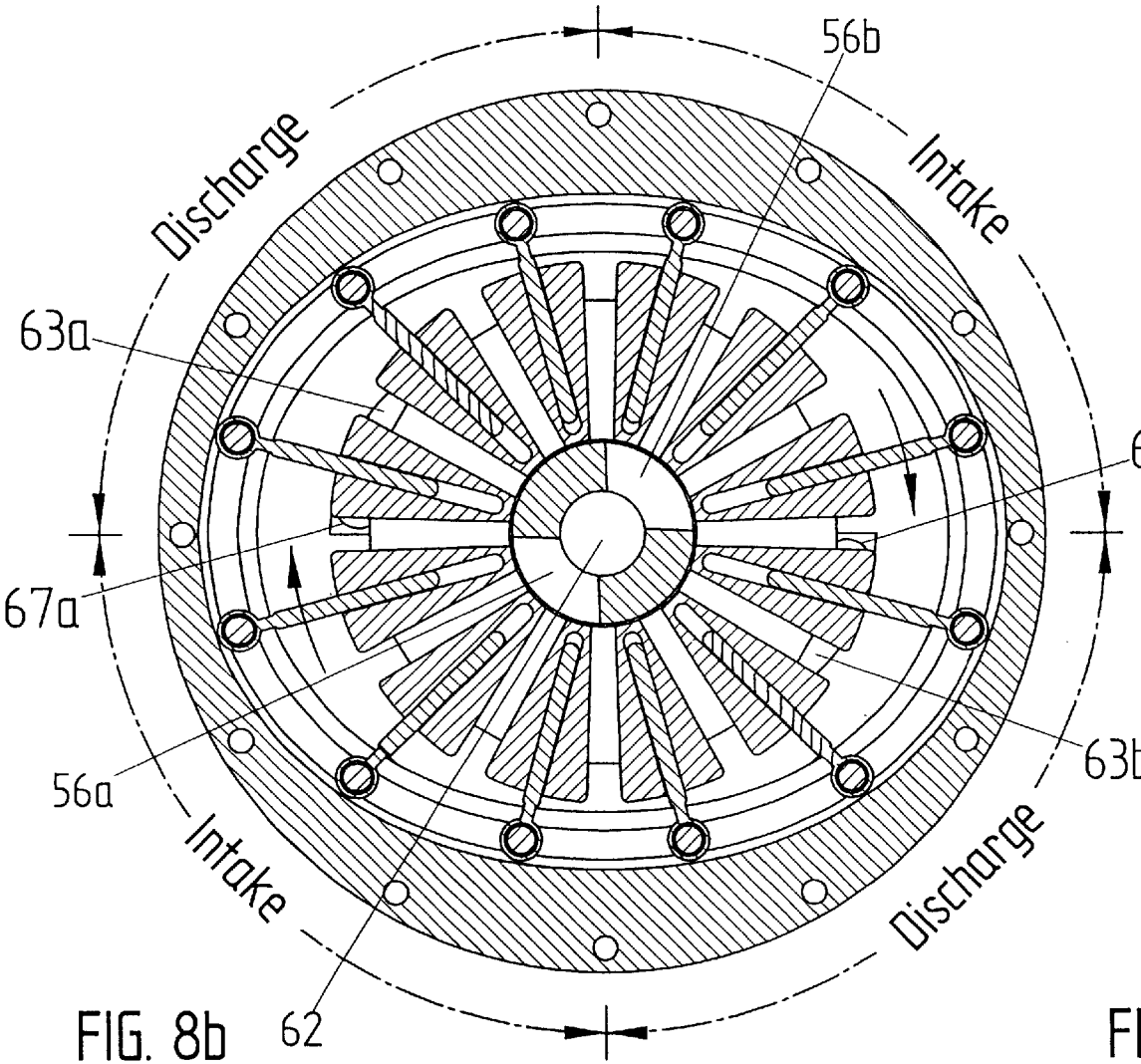
FIG. 8*b* is a sectional view taken along line 8*b*—8*b* of FIG. 7*b*.

The rotary power device 10 can be easily converted to serve a different purpose other than the four-cycle internal combustion engine. This is accomplished by a simple replacement of the internal stator portion 40 and a corresponding change in the disposition of ports in the external stator, as shown in FIG. 7*b* and FIG.8*b*, corresponding the device 10*b* shown in FIG. 6*b*. One such embodiment is a device that can function as one of double-action pump/compressor or a fluid-driven motor In this configuration, the central stator comprises a single intake channel 62 connected to two diagonally opposed peripheral intake ports 56*a*, 56*b*; and the inner wall of the external stator comprises two diagonally disposed passageways 63*a*, 63*b* formed as recessed inner wall portions of the external stator and connected to respective discharge ports 67*a*, 67*b*. Each of these passageways extends over a ninety degree angular displacement and is disposed in alternating relationship with respect to the intake ports.

In functioning as a pump or compressor, the rotor is made to rotate by coupling the end shaft 18 to a driving means such as a motor. A sealed cavity is enclosed between two vanes having outer vane tips making small clearance engagement with the toroidal wall and side wall of the chamber. Each cavity is preferably bounded by two vanes and encloses a radial compartment that goes through two ninety degree angular displacements of expanding volume alternated by two ninety degree angular displacements of contracting volume. During the expanding volume ranges, fluid is sucked in as the inner opening 46 registers with intake ports 56*a*, 56*b*. During the contracting volume ranges the fluid is pressurized and expelled as the inner opening 46 registers with discharge passageways 63*a*, 63*b* connected to respective discharge ports 67*a*, 67*b*. Thus, simultaneous processes of diagonal intake and diagonal exhaust take place as the rotor rotates.

In functioning as a fluid driven motor or expander device, a pressurized fluid communicated through the intake channels 62 in communication with the ports 56*a*, 56*b* provides a net turning force on the differential extended vane area as the cavities expand, thus causing rotation of the rotor. At the same time, the resulting rotation causes the expulsion of the depressurized fluid through discharge passageways 63*a*, 63*b* that are connected to respective discharge ports 67*a*, 67*b* when the cavities contract in volume.

Figures 7C, 8C:
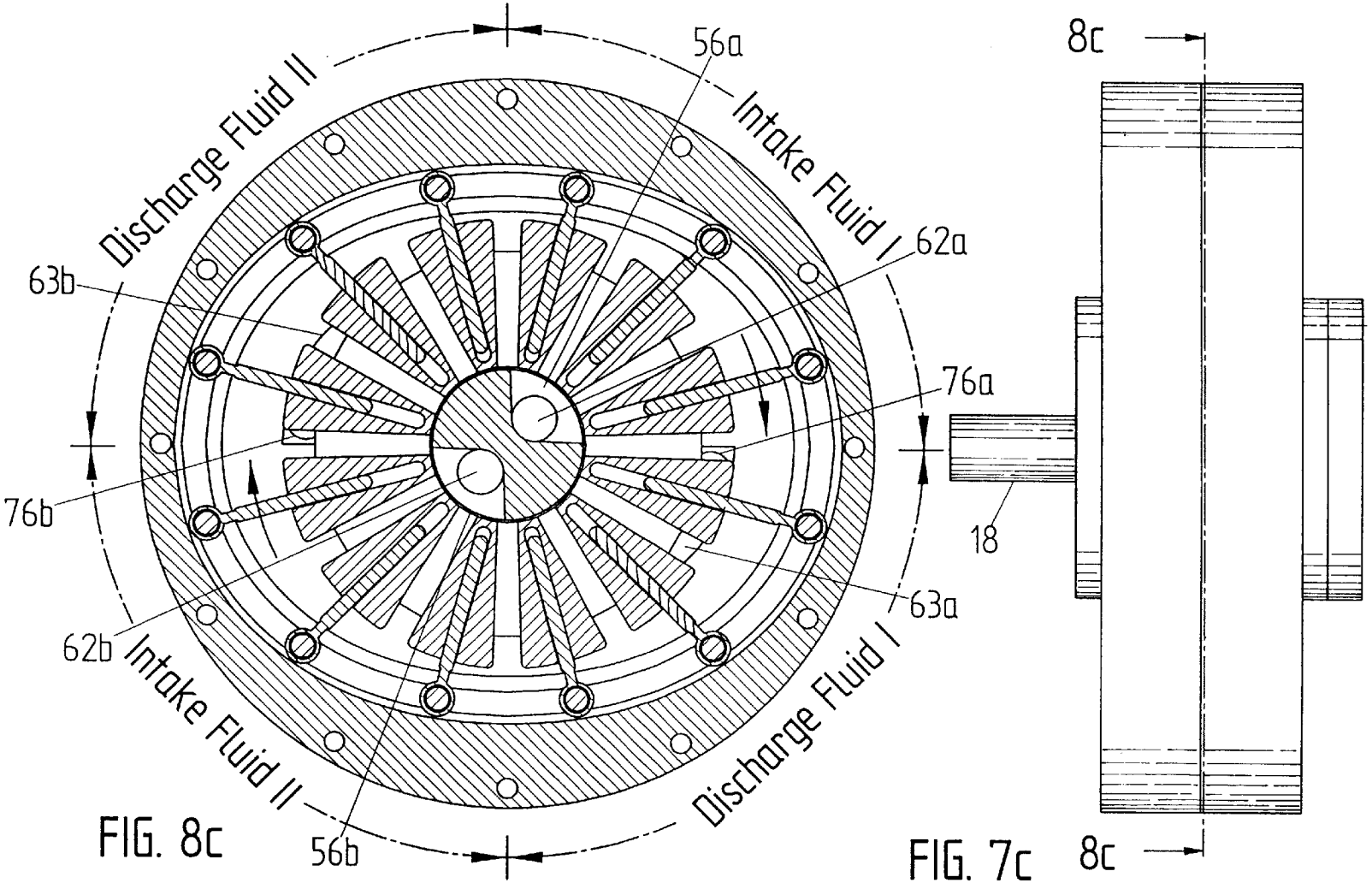
FIG. 7*c* is a side elevation view of the rotary power device of FIG. 6*c*.
FIG. 8*c* is a sectional view taken along line 8*c*—8*c* of FIG. 7*c*.
Figure 7D:
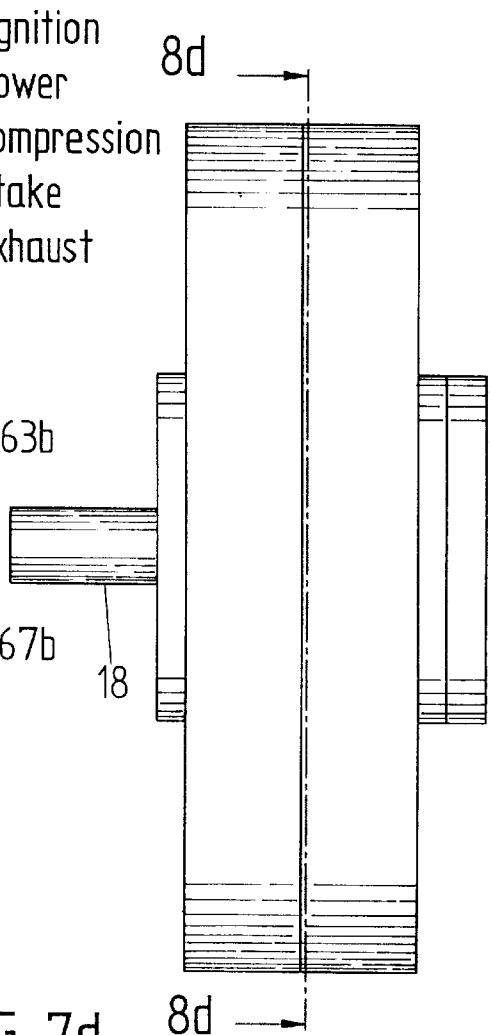
FIG. 7*d* is a side elevation view of the rotary power device of FIG. 6*d*.

Still another embodiment is a rotary power device operating as a fluid-driven pump or as an energy recovery device as shown in FIG. 7*c* and FIG. 8*c*, which correspond to a device 10*c* shown in FIG. 6*c*. Exemplar applications include operation as a fluid-driven pump or compressor, as a turbocharger for internal combustion engines and as an energy recovery device useful in reverse osmosis plants. In this embodiment the internal central stator portion comprises two separate intake channels 62*a*, 62*b*, each connected to a respective diagonally opposed port 56*a*, 56*b* corresponding to the two differently pressurized fluids. The inner wall of the external stator comprises two diametrically disposed discharge passageways 63*a*, 63*b* formed as a recessed inner wall portion and connected to respective discharge ports 67*a*, 67*b* associated with the two fluids. In operation as a fluid driven pump or energy recovery device, a fluid I of higher pressure is communicated to one intake channel, for example 62*a*, and a second fluid II of lower pressure is communicated to a second intake channel 62*b*. The higher pressure fluid I fills one quadrant of expanding cavities during the intake phase and discharges fluid through the subsequent quadrant of contracting cavities registering with discharge passageway 63*a* connected to the discharge port 67*a* during the discharge phase. Similarly, the lower pressure fluid II fills a diagonally opposing quadrant of expanding cavities during the intake phase and discharges fluid through the subsequent quadrant of contracting cavities registering with discharge passageway 63*b* connected to discharge port 67*b* during the discharge phase. The effect of net pressure forces on vanes caused by the high-pressure fluid during the intake phase is to impart rotation to the rotor and to pressurize the lower pressure fluid in the diagonally contracting cavities. Thus, a pressure energy exchange takes place whereby a significant portion of the higher-pressure fluid I energy is converted to hydraulic pressure energy transmitted to the lower-pressure energy fluid II, with the remaining portion of energy comprising friction losses and mechanical energy of the rotating rotor.

In still another embodiment, the rotary power device 10 can be configured as a two-cycle internal combustion engine as depicted in FIG. 7*d*, FIG. 8*d*, FIG. 9 and FIG. 10, corresponding to the device shown in FIG.6*d*. In this embodiment, the internal stator comprises an intake passageway 62 connected to diagonal opposed intake ports 56*a*, 56*b*, and the external stator comprises diagonally opposed exhaust passageways 63*a*, 63*b* connected to respect exhaust ports 67*a*, 67*b*. Each exhaust passageway is formed as a recessed wall portion in the inner wall of the external stator extending over an angular displacement enclosing the respect angular displacement of the intake port. A pair of diagonally disposed ignition ports 65*a*, 65*b* comprising ignition means is included in the external stator portion.

Figure 8D:
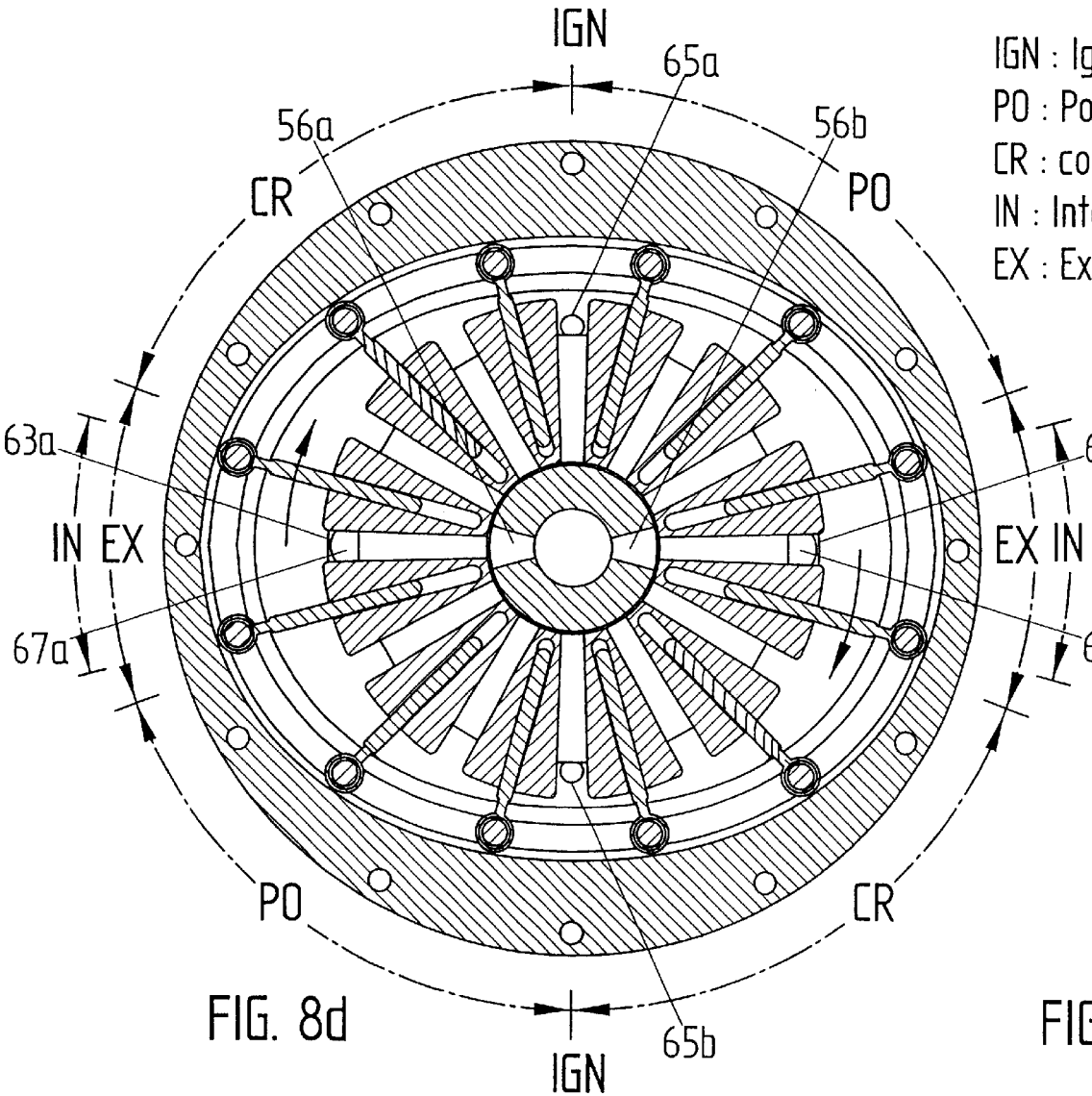
FIG. 8*d* is a sectional view taken along line 8*d*—8*d* of FIG. 7*d*.
Figure 9:
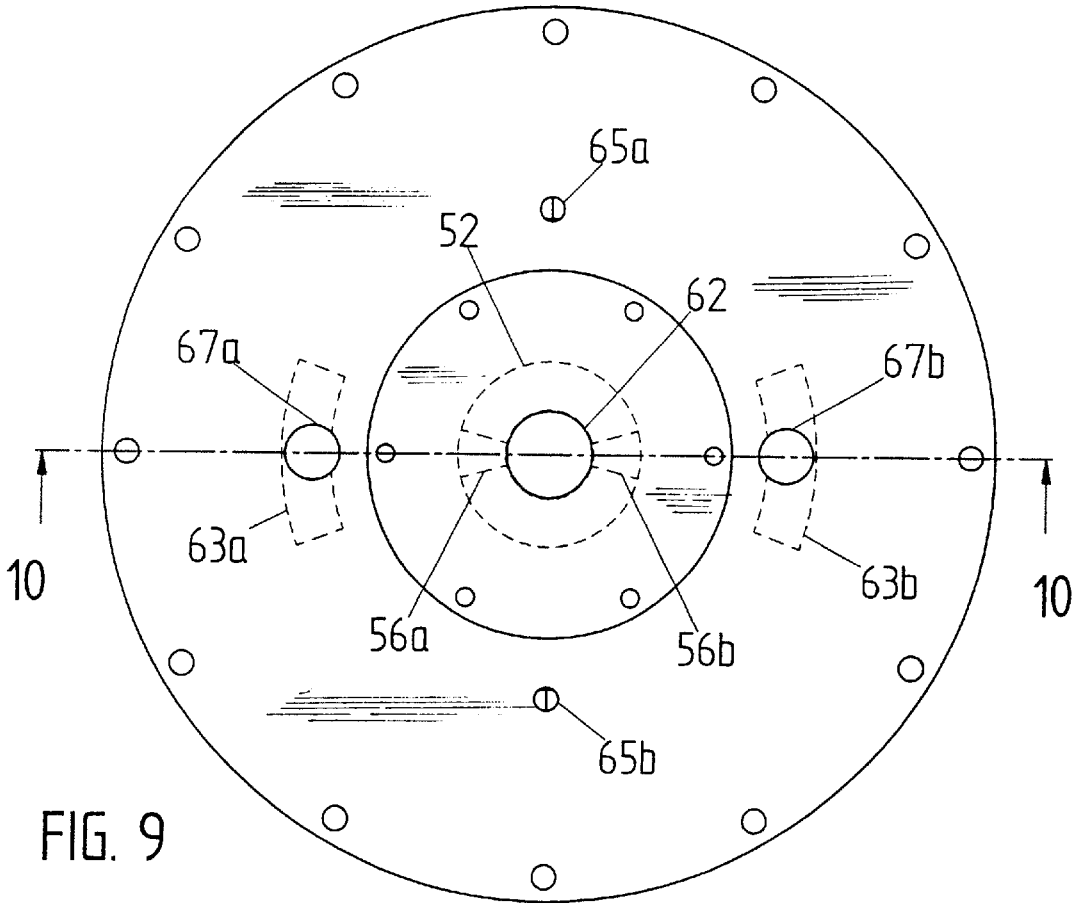
FIG. 9 is an end view of the rotary power device of FIG. 6*d*.
Figure 10:
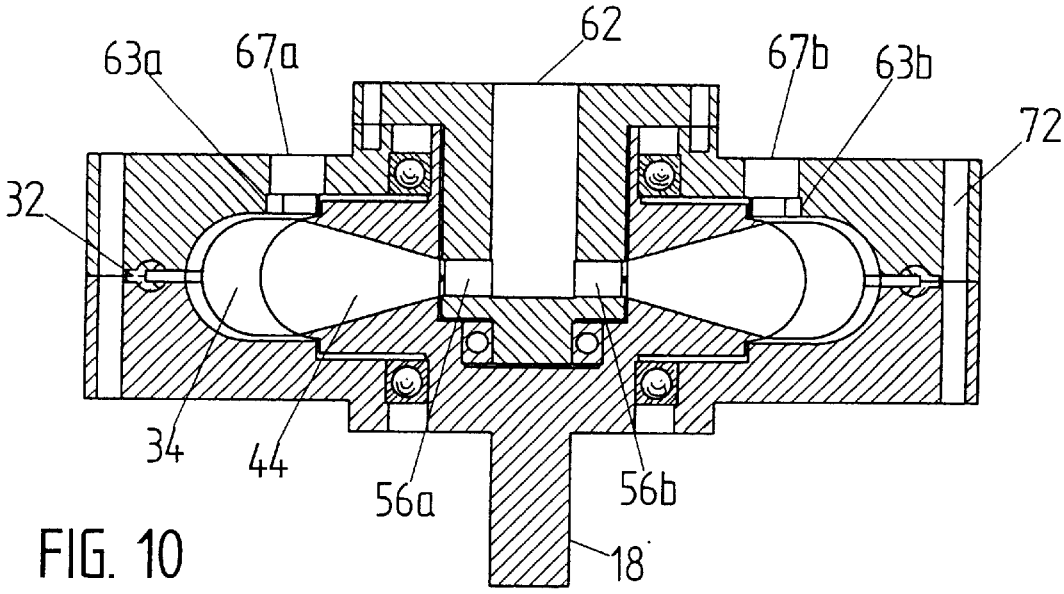
FIG. 10 is a sectional view taken along line 10—10 of FIG. 9.

The operation of the two-cycle engine may be explained with reference to FIG. 8*d*. In this embodiment the rotor goes through three distinct doubly repeating phases comprising compression, power, and exhaust-scavenging phases. Each set of three phases takes place within one hundred eighty degrees of rotor revolution and each phase takes place simultaneously with a similar diagonally opposed phase of the other set. During the exhaust-scavenging phase in which the intake ports 56*a*, 56*b* overlap with portions of the respective exhaust passageways 63*a*, 63*b* the intake charge displaces the products of combustion which are expelled through ports 67*a* and 67*b*, respectively. During the compression phase the entrapped charge is compressed as cavities contract to their respective minimum values, during which time the compartment inner openings 46 are blocked by the peripheral wall of the internal stator. A double diagonal opposed ignition or fuel injection actuates simultaneously commencing at the beginning of the power phase as sectors of opposing cavities expand. The power phase is followed by an exhaust blow down phase as the cavities start registering with exhaust passageways 63*a*, 63*b* over a small angular displacement followed by a scavenging phase.

As will be understood by those skilled in the art, various embodiments other than those described in detail in the specification are possible without departing from the scope of the invention will occur to those skilled in the art. It is, therefore, to be understood that the invention is to be limited only by the appended claims.

What is claimed is:

1. A radial vane rotary power device comprising a stator and a rotor assembly rotatable about an axis of rotation of an end shaft protruding through a front end wall portion of the stator;

wherein the stator comprises:

an external stator portion defining an internal volume having a substantially oval cross-section perpendicular to the axis, the internal volume bounded by front and back external stator portions, the front external stator portion comprising a central throughhole for receiving the end shaft; the external stator portion further comprising a cam track disposed about the internal volume in a plane perpendicular to the axis, the cam track open to the internal volume;

an internal cylindrical stator portion centrally projecting from the back external stator portion into the internal volume along the axis of rotation, the internal stator portion having at least one passageway formed therein, the at least one passageway comprising an intake channel extending along the axis and communicating with at least one radial intake port formed in a peripheral wall of the internal stator portion, and wherein the rotor assembly portion comprises a block comprising a central cylindrical bore for receiving the internal stator portion, the block rotatable within a rotor chamber portion of the internal volume lying between the internal stator portion and the external stator portion, the block comprising a selected number, greater than one, of radial compartments equally spaced apart about the axis of the device, each of the compartments open to a peripheral surface of the block, each of the compartments having a respective inner opening for communicating intermittently with the at least one radial port in the peripheral wall of the internal stator portion as the rotor assembly rotates, the rotor assembly further comprising the selected number of radially extending vane assemblies slidably disposed in respective slots within the block in alternating relation with the radial compartments, each of the vane assemblies comprising a respective stub extending radially outward from a body portion of the respective vane, the respective stub retaining a respective cam follower captured in the cam track.

2. The radial vane rotary power device of claim 1 wherein the external stator portion further comprises a pair of circumferentially-split mating portions split along a medial transverse plane perpendicular to the axis; each of the mating portions comprising a mirror image portion of the cam groove formed in a recessed wall portion encircling the internal volume.

3. The radial vane rotary power device of claim 1 wherein each of the cam followers comprises a respective self-lubricating ball element.

4. The radial vane rotary power device of claim 1 wherein the internal stator portion comprises at least two passageways comprising:

at least one inlet passageway comprising an intake port communicating with each radial compartment in the course of each rotation of the block; and at least one exhaust passageway comprising an exhaust port communicating with each radial compartment in the course of each rotation of the block; and the external stator portion comprises at least one ignition port communicating with each radial compartment during each rotation of the block;

whereby the radial vane rotary power device is adapted to function as a four-cycle internal combustion engine.

5. The radial vane rotary power device of claim 1 wherein the internal stator portion comprises at least one passageway comprising an inlet passageway comprising an intake port communicating with each radial compartment in the course of each rotation of the block; and the external stator portion comprises at least one exhaust passageway comprising an exhaust port communicating with each radial compartment in the course of each rotation of the block; and the external stator portion comprises at least one ignition port communicating with each radial compartment in the course of each rotation of the block;

whereby the radial vane rotary power device is adapted to function as a four-cycle internal combustion engine.

6. The radial vane rotary power device of claim 1, wherein the internal stator portion comprises at least one passageway comprising an inlet passageway connected to a pair of diagonal ports, each port communicating with each radial compartment in the course of each rotation of the block; and the external stator comprises at least a diagonal pair of discharge passageways connected to at least one discharge port, each discharge passageway communicating with each radial compartment in the course of each rotation of the block;

whereby the radial vane rotary power device is adapted to function as one of a pump, a compressor, a fluid-driven motor and an expander device.

7. The radial vane rotary power device of claim 1 wherein:

the internal stator portion comprises at least two passageways comprising:

a first fluid inlet passageway connected to a first inlet port communicating with each radial compartment in the course of each rotation of the block;

a second fluid inlet passageway connected to a second inlet port communicating with each radial compartment in the course of each rotation of the block; and the external stator portion comprises a first fluid discharge passageway connected to the first fluid discharge port communicating with each radial compartment in the course of each rotation of the block; and the external stator portion comprises a second fluid discharge passageway connected to the second fluid discharge port communicating with each radial compartment in the course of each rotation of the block;

whereby the radial vane rotary power device is adapted to function as one of a fluid-driven pump, a fluid-driven compressor, and a work exchanger device for recovery of energy between two differently pressurized fluids.

8. The radial vane rotary power device of claim 1 wherein the internal stator portion comprises at least one passageway comprising an inlet passageway connected to a pair of diagonal intake ports, each port communicating with each radial compartment in the course of each rotation of the block; and the external stator portion comprises a pair of diagonal exhaust passageways connected to at least one discharge port, each exhaust passageway communicating with each radial compartment in the course of each rotation of the block; and the external stator comprises at least a pair of diagonal ignition ports adapted to receive respective ignition means, each ignition means communicating with each radial compartment during each rotation of the block;

whereby the radial vane rotary power device is adapted to function as two-cycle internal combustion engine.

9. A four-cycle rotary internal combustion engine comprising:

an external stator portion defining an internal volume having an oval-shaped transverse cross-section, the external stator portion comprising a pair of circumferentially split portions mating along a medial transverse plane perpendicular to the axis of rotation to form front and back external stator portions; the front external stator portion comprising a central throughhole for receiving the end shaft, each front and back external stator portion comprising a respective mirror image cam groove formed in the mating plane so as to define a cam track encircling the internal volume when the two circumferentially split portions are mated together; and an internal stator portion comprising an axial cylindrical protrusion inwardly projecting from the back external stator portion and concentrically aligned with the internal volume, the internal stator comprising at least one inlet passageway communicating with at least one peripheral port;

a rotor assembly portion comprising a block comprising a central cylindrical bore for receiving the internal stator portion, the block rotatable within a rotor chamber portion of the internal volume lying between the internal stator portion and the external stator portion, the block comprising a selected number, greater than one, of radial compartments equally spaced apart about the axis of the device, each of the compartments open to a peripheral surface of the block, each of the compartments having a respective inner opening for intermittently communicating with the at least one axially aligned radial port in the peripheral wall of the internal stator portion as the rotor assembly rotates, the rotor assembly further comprising the selected number of radially extending vane slots disposed within the block in alternating relation with the radial compartments; and a selected number of vane assembles, each comprising a respective vane body portion slidably received in a respective rotor slot and a respective outer cam follower portion medially fixed to the inner portion by means of a respective stub extending radially outward from the respective inner flat portion, the respective cam follower slidably received in the cam track; and an end shaft protruding outwardly from one end of the rotor block through the central hole in the front external stator portion.

10. The four-cycle rotary internal combustion engine of claim 9 wherein the internal stator portion further comprises an exhaust passageway communicating with a peripheral exhaust port; and the external stator comprises an ignition port for receiving an ignition means.

11. The four-cycle rotary internal combustion engine of claim 9 wherein the internal stator portion comprises an intake passageway communicating with a peripheral intake port; and the external stator portion comprises an exhaust passageway and an ignition means.

12. A rotary power device operable as one of a pump and an expander, the power device comprising:

an external stator portion defining an internal volume having an oval-shaped transverse cross-section, the external stator portion comprising a pair of circumferentially split portions mating along a medial transverse plane perpendicular to the axis of rotation so as to form front and back external stator portions; the front external stator portion comprising a central throughhole for receiving the end shaft, each of the front and back external stator portion comprising a respective mirror image cam groove abutting the medial transverse plane so as to form a cam track encircling the internal volume when the pair of circumferentially split portions are mated together; and an internal stator portion comprising an axial cylindrical protrusion inwardly projecting from the back external stator portion and concentrically aligned with the internal volume, the internal stator comprising at least one inlet passageway communicating with at least one pair of diagonal opposed peripheral ports; and a rotor assembly portion comprising a block comprising a central cylindrical bore for receiving the internal stator portion, the block rotatable within a rotor chamber portion of the internal volume lying between the internal stator portion and the external stator portion, the block comprising a selected number, greater than one, of radial compartments equally spaced apart about the axis of the device, each of the compartments open to a peripheral surface of the block, each of the compartments having a respective inner opening communicating with the at least one axially aligned radial port in the peripheral wall of the internal stator portion during the course of each rotation of the rotor assembly, the rotor assembly further comprising the selected number of radially extending vane slots disposed within the block in alternating relation with the radial compartments; and the selected number of vane assembles comprising respective inner flat portions slidably received in respective rotor slots and respective outer cam follower portions medially fixed to the respective inner portion by means of respective stub portions extending radially outward from the respective inner portions, each of the cam follower portions slidably received in the cam track; and an end shaft protruding outwardly from one end of the rotor block through the central hole in the front external stator portion.

13. The rotary pump or expander device of claim 12 wherein the external stator portion comprises two diametrically opposed exhaust passageways, each passageway comprising a respective recessed wall portion in the inner wall of the external stator.

14. A fluid-driven device operable as one of a pump and a compressor, the fluid-driven device comprising a rotor assembly rotatably mounted within an annular chamber defined by the substantially oval inner wall of an external stator portion and a circular peripheral wall of a central internal stator portion fixed to the external stator portion; the external stator portion comprising a pair of circumferentially-split portions mating along a transverse plane perpendicular to an axis of rotation, each of the mating portions comprising a respective cam groove portion configured so as to define a medial cam track surrounding the annular chamber when the two circumferentially split portions are mated together; and a rotor assembly portion comprising a block comprising a central cylindrical bore for receiving the internal stator portion, the block comprising a selected number, greater than one, of radial compartments equally spaced apart about the axis of rotation, each of the compartments open to a peripheral surface of the block, each of the compartments having a respective inner opening for intermittently communicating with the at least one axially aligned radial port in the peripheral wall of the internal stator portion as the rotor assembly rotates, the rotor assembly further comprising the selected number of radially extending vane slots disposed within the block in alternating relation with the radial compartments; and the selected number of vane assembles, each of the vane assemblies comprising a respective inner flat portion slidably received in a respective rotor slot and a respective outer cam follower portion medially attached to the respective inner portion by means of a respective stub portion extending radially outward from the respective inner portion, each of the cam follower portions received in the cam track; and wherein the internal stator portion comprises a first fluid inlet passageway connected to a first inlet port intermittently communicating with each radial compartment in the course of each rotation of the block; and a second fluid inlet passageway connected to a second inlet port intermittently communicating with each radial compartment in the course of each rotation of the block; and wherein the external stator portion further comprises a first fluid discharge passageway connected to the first fluid discharge port intermittently communicating with each radial compartment in the course of each rotation of the block; and a second fluid discharge passageway connected to the second fluid discharge port intermittently communicating with each radial compartment in the course of each rotation of the block.

15. A two-cycle internal combustion engine comprising a rotor assembly rotatably mounted within an annular chamber defined by a substantially oval-shaped inner peripheral wall of an external stator portion and a circular peripheral wall of a central internal stator portion; the external stator portion comprising a pair of circumferentially split portions mating along a transverse plane perpendicular to the axis of rotation, each of the circumferentially-split stator portions comprising a mirror image cam groove portion abutting the transverse plane and extending around the internal volume so as to define a cam track when the two circumferentially split portions are mated together; and a rotor assembly portion comprising a block comprising a central cylindrical bore for receiving the internal stator portion, the block comprising a selected number, greater than one, of radial compartments equally spaced apart about the axis of the device, each of the compartments open to a peripheral surface of the block, each of the compartments having a respective inner opening for intermittently communicating with the at least one axially radial port in the peripheral wall of the internal stator portion as the rotor assembly rotates, the rotor assembly further comprising the selected number of radially extending vane slots disposed within the block in alternating relation with the radial compartments; and the selected number of vane assembles, each of the vane assemblies comprising a respective inner flat portion slidably received in a respective rotor slot and a respective outer cam follower portion medially attached to the respective inner portion by means of a respective stub portion extending radially outward from the respective inner portion, each of the cam follower portions slidably received in the cam track; and wherein the external stator portion further comprises at least two diagonal exhaust passageway connected to at least one discharge port, each passageway communicating with each radial compartment in the course of each rotation of the block; and at least a pair of diagonal ignition ports, each of the ports comprising a respective ignition means, each ignition means sequentially communicating with each radial compartment during each rotation of the block.

16. Apparatus for actuating radial motion of a vane in a sliding vane rotary power device in which a body portion of the vane slidably disposed within a radially oriented rotor slot follows a rotor chamber wall during the course of rotation of the rotor about an axis, the apparatus comprising:

a cam track extending around the rotor chamber wall, the cam track having mirror symmetry about a plane perpendicular to the axis, the cam track comprising a narrow portion connecting the rotor chamber to an enlarged portion of the cam track; and a cam follower portion medially attached to the body of the vane by means of a stub portion extending radially outward from the body of the vane, the cam follower portion captured in the enlarged portion of the cam track.

17. The apparatus of claim 16 wherein the cam track comprises two mirror image groove portions mated along a plane perpendicular to the axis of rotation.

18. The of claim 16 wherein the cam follower comprises a tip ring portion capturing a freely sliding element.

19. The apparatus for vane actuation according to claim 18 wherein the freely sliding element comprises a self-lubricating ball element.

* * * * *